United States Patent [19]

Mahaffey et al.

[11] 4,213,073

[45] Jul. 15, 1980

[54] ROD PINCH DIODE

[75] Inventors: Redge A. Mahaffey, Wheaton; Shyke A. Goldstein, Rockville; Jeffry Golden, Laurel; Gerald Cooperstein, Rockville, all of Md.

[73] Assignee: The United States of America as represented by the Secretary of the Navy, Washington, D.C.

[21] Appl. No.: 944,238

[22] Filed: Sep. 20, 1978

[51] Int. Cl.[2] ..... H01J 1/14; H01J 1/20; H01J 11/14

[52] U.S. Cl. ..... 313/310; 313/359; 313/356; 315/111.7; 315/111.8; 328/233

[58] Field of Search ..... 315/111.2, 111.7, 111.8, 315/111.9; 313/342, 359, 356, 310; 328/233

[56] References Cited

U.S. PATENT DOCUMENTS

| | | | |
|---|---|---|---|
| 2,411,241 | 11/1946 | Arnott et al. | 313/356 X |
| 3,156,842 | 11/1964 | McClure | 315/111.9 X |
| 3,345,820 | 10/1967 | Dryden | 315/111.9 X |
| 3,579,028 | 5/1971 | Paine | 315/111.2 |
| 3,602,763 | 8/1971 | Hall | 313/342 |
| 3,760,286 | 9/1973 | Kelly | 315/111.9 |
| 3,935,504 | 1/1976 | Guillaneux et al. | 315/111.7 |
| 3,944,873 | 3/1976 | Franks et al. | 315/111.8 |

*Primary Examiner*—Saxfield Chatmon, Jr.
*Attorney, Agent, or Firm*—R. S. Sciascia; Philip Schneider

[57] ABSTRACT

An improved diode for forming an intense electron beam and propagating the beam. The diode includes a cathode having a bore, and a rod-shaped anode having a medial tapered section which extends, approximately coaxially, through the bore of the cathode. The anode tapers at or near the cathode and is formed from electrically conductive material. The cathode is made from a material which rapidly emits electrons during the early stage of an applied voltage pulse. The electrons strike the anode and form a plasma thereon. Sufficient anode current and the formation of sufficient anode plasma affect the magnetic and electric fields to pinch the electrons closer to each other and to force the electron beam to propagate along the anode and away from the cathode and voltage supply. The tapered section of the anode increases the velocity of the pinch and the density of the electron beam.

8 Claims, 11 Drawing Figures

ROD PINCH DIODE

BACKGROUND OF THE INVENTION

This invention relates generally to pinch diodes and especially to an improved diode which produces an intense electron beam pinch and efficiently propagates the beam energy along the anode.

The efficient propagation of an intense electron beam is highly desirable for many reasons, among which are the abilities to apply the energy of the beam at a sufficient distance to avoid damage to the power source, and to confine a target to a specific location. Such features are especially important, for example, in order to irradiate a solid target pellet for material response studies, to produce and heat high-temperature plasmas, and to produce an intense localized source of x-rays.

Existing devices for producing an intense flow of electrons include the dielectric-rod-cathode diode (Bennett diode), the planar and hemispherical pinched electron beam diodes, and planar diodes with exploding wires on axis. These devices propagate electron beams with very low efficiency, typically on the order of only a few percent over distances greater than or equal to 10 centimeters. External techniques for propagating beams outside of these devices include exploding-wire discharge channels, z-pinch discharge guides and laser-initiated discharges. These techniques guide the beam through a preformed plasma discharge. However, the propagation efficiency reported for these techniques does not exceed 50%. Moreover, these techniques usually require large, expensive, and complex external equipment.

Pinch propagation along rod—and cylindrical-shaped anodes of a diode for producing a multimicrosecond pulse of x-rays has been observed by K. F. Zelenskii, O. P. Pecherskii, and V. A. Tsukerman (Soviet Physics-Technical Physics, Vol. 13, No. 9, March, 1969, pp 1284–1289). The Zelenskii et al. device operates at high impedance (approximately 200 ohms) and the anode includes a cylinder having either a small constant radius which provides a slow pinch formation and very low currents, or a large constant radius which results in higher current but slow pinch propagation and low current density. Although that device forms an anode surface plasma, the anode, because of its shape and material, may not produce high ion fluxes, fast pinch formation and propagation, or operate at low impedance. In addition the metal cathodes of that device do not emit electrons rapidly enough in that configuration for operation with applied voltage pulses shorter than 0.1 microsecond.

SUMMARY OF THE INVENTION

It is the general purpose and object of the present invention to rapidly produce an intense electron beam pinch and accurately and efficiently control the propagation of the beam. This and other objects of the present invention are accomplished by a diode having a rod-shaped anode which includes a section of wide diameter, a section of narrow diameter, and a tapered section therebetween. The anode extends through a bore of a cathode so that the tapered section is at or near the cathode.

Electrons emitted from the cathode strike the anode and form a plasma at the surface of the anode. The plasma provides ions which contribute positive space charge to the region where electrons flow and thereby permits the flowing electrons to pinch together and allows the electron pinch to propagate along the surface of the anode away from the cathode. The areal velocity of the electron pinch $V_a(V_a=\pi DV_z$, where D is the diameter of the anode and $V_z$ is the axial velocity of the pinch) is constant and is insensitive to the diameter of the anode. Therefore, as the diameter of the anode decreases along the tapered section, the axial velocity of the pinch increases. Also, since the number of electrons about the surface of the anode is constant, the density of the electron beam increases as the diameter of the anode decreases.

The invention produces a radial flux of ions which, for example, can generate fluxes of neutrons by nuclear reactions induced when the radially moving ions strike a suitable target. The device provides a source of localized x-rays, may be used to irradiate pellets, and may be powered by a moderate or low impedance pulsed voltage supply.

Other objects and advantages of the invention will become apparent from the following detailed description of the invention when considered in conjunction with the accompanying drawing wherein:

DETAILED DESCRIPTION OF THE INVENTION

Figure 1:
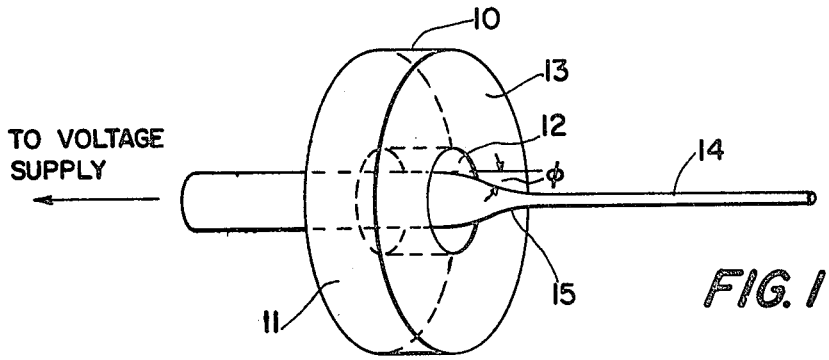
FIG. 1 is an isometric view of the anode positioned relative to the cathode.

Referring now to the drawing, wherein like reference characters designate like or corresponding parts throughout the several views, FIG. 1 shows a cathode 10 made of material, such as carbon, which rapidly emits electrons during the early stage of an applied voltage pulse. The cathode 10 may be any suitable shape but is preferably cylindrical with flat approximately parallel surfaces 11 and 13. The cathode 10 has a bore 12 which is preferably both cylindrical and symmetrical about the longitudinal axis of the cathode. The bore 12 extends the entire length of the cathode 10. An anode 14, made from an electrically conductive material, such as brass, copper, stainless steel, lead, or tantalum, of which brass is preferred, is in the form of a rod having a section of wide diameter, a section of narrow diameter and a tapered section therebetween. The taper terminates in a smooth, curved transition 15 to the narrow section of the anode 14.

The cathode 10 has a convenient length of 2 centimeters (cm) and has a suitable outer diameter of 20 cm. The diameter of the bore 12 is 4 cm. The wide section of the anode 14 has a diameter of 3.2 cm and is 5 cm in length. The tapered section is 4 cm long and the narrow section has a diameter of 0.16 cm and is 21 cm in length. The taper angle $\phi$ is 20°. All the dimensions of the cathode 10 and anode 14 are approximate and the effect of varying the dimensions will be discussed hereinafter.

The longitudinal axis of the anode 14 is approximately concentric with the longitudinal axis of the bore 12 of the cathode 10 such that the anode extends coaxially through the bore and beyond the surfaces 11 and 13 of the cathode. A circumferential spacing, preferably symmetrical, remains between the anode 14 and cathode 10. The wide tip of the anode 14 is coupled to a pulsed voltage supply.

Figure 2A:
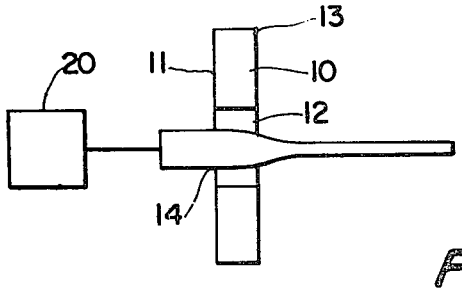
FIGS. 2*a*–2*c* are sectional schematics showing the anode tapered relative to the cathode.
Figure 2B:
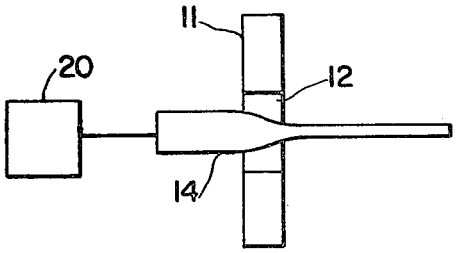
Figure 2C:
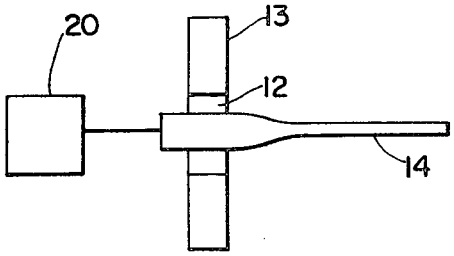

The anode 14 may begin to taper within the bore 12 of the cathode 10, (see FIG. 2*a* for example), or slightly externally to the bore and either between the surface 11 of the cathode and the voltage supply 20, (see FIG. 2*b*), or beyond the surface 13 of the cathode farthest from the voltage supply 20, (see FIG. 2*c*). The taper of the anode 14 may terminate either within the bore 12 or externally of the bore and beyond the surface 13 of the cathode 10 farther from the voltage supply 20.

Figure 3:
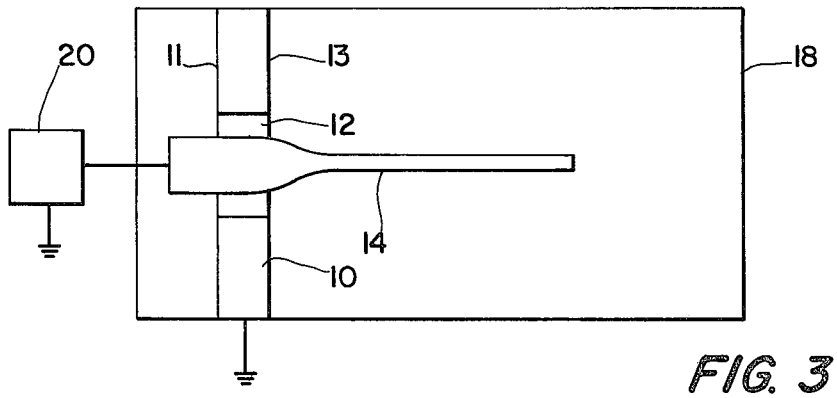
FIG. 3 is a cutaway schematic view of an embodiment of the present invention.

FIG. 3 portrays an embodiment of the anode 14 and cathode 10 enclosed within a grounded chamber 18 in which a vacuum below $10^{-3}$ Torr is maintained. The chamber 18 is of a size which will conveniently hold the anode 14 and cathode 10, and is fabricated from any material, such as stainless steel, which will hold a vacuum. The positive terminal of a high-voltage supply 20 typically passes through an insulating wall of the chamber 18 and connects to the anode 14. The chamber 18 and cathode 10 are suitably grounded. The high-voltage supply 20 used in the present invention is a Gamble I generator which produces a 300–800 kilovolt (KV) positive pulse for a 50–150 nanosecond (ns) duration. However, any high-voltage supply which is capable of producing a large positive pulse within the range of hundreds of kilovolts to megavolts may be utilized with the present invention. The duration of the pulse may range between approximately 10 nanoseconds and microseconds. Although the present invention utilizes a brass anode 14, any electrically conductive anode which readily produces a plasma and can withstand the desired voltage and pulse duration is suitable.

Figure 4A:
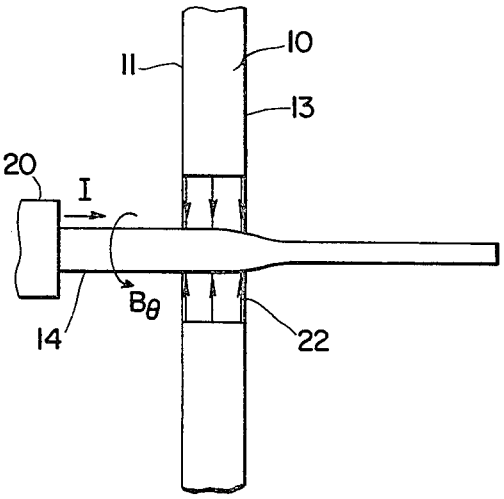
FIGS. 4*a*–4*d* are sectional schematics illustrating the formation and propagation of an electron beam pinch.
Figure 4B:
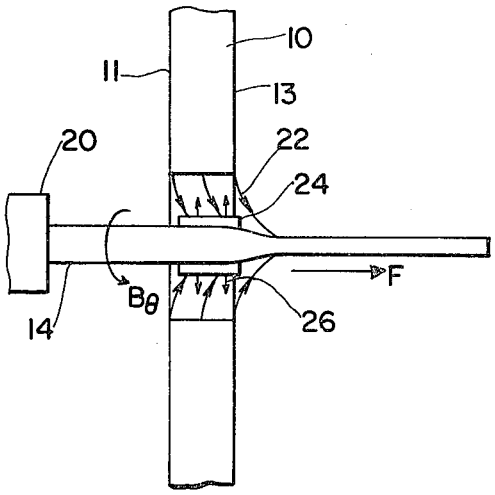

In operation, as illustrated in FIG. 4*a*, a positive pulse is applied to the anode 14. The cathode 10 emits electrons 22 which strike the anode 14. Current, I, flows in the anode 14 to produce a magnetic field, $B_\theta$ about the anode. The striking electrons 22 form a plasma 24 on the anode 14 as depicted in FIG. 4*b*. The plasma 24 is an electrical conductor and reduces the effective spacing between the anode 14 and cathode 10, and provides ions 26 which participate in the electrical conduction of the device. The presence of positive ion electric charge in the spacing between the anode 14 and cathode 10 permits the total diode current to exceed the critical current (i.e., the maximum current attainable because of the self-magnetic field effects) for the radial geometry of the present invention and thereby develops an intense electron beam. The radial velocity $V_r$ of the electrons 22 and the strengthened magnetic field $B_\theta$ due to the increased current produce a Lorentz force $F[F=(V_r \times B_\theta)q]$ which curves the trajectories of the intense electron beam closer to each other, thereby greatly increasing the electron density, and in the direction toward the narrow tip of the anode 14 away from the cathode 10 and voltage supply 20.

The initial emission of the electrons 22 from the cathode 10 is most dense at a location within the bore 12 where the electric field at the cathode is highest, that is, near the location where the distance between the anode 14 and cathode is shortest. The electron trajectories curve as described above and the electrons 22 flow along the length of the anode 14 to form an electron pinch. The velocity of the pinch and the density of the current increase as the radius of the anode 14 decreases, that is, along the taper of the anode. The taper must be gradual and smoothly terminate so that the electron beam continues to follow the surface of the anode.

Figure 4C:
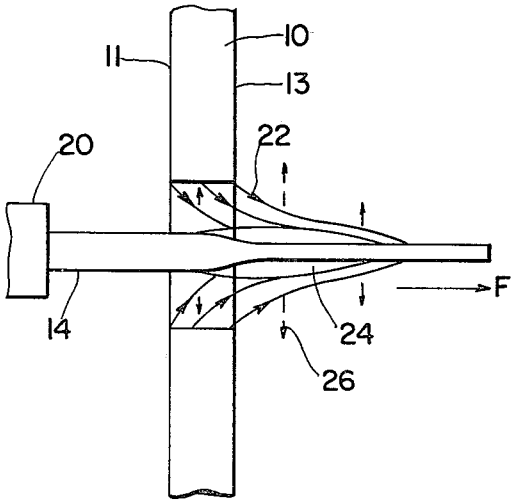
Figure 4D:
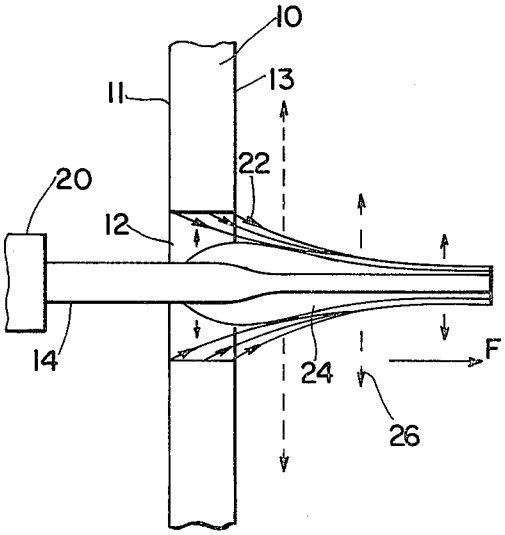

The pinched beam propagates about the anode 14 and forms more plasma 24 farther along the portion of anode which protrudes beyond the cathode 10 as shown in FIG. 4*c*. This enables the pinched beam to propagate farther along the anode 14. As the beam propagates, the plasma 24 expands and reduces the anode-cathode spacing as shown in FIG. 4*d*, thereby decreasing the impedance of the device.

Upon reaching the tip of the anode 14, the electron beam strikes and irradiates a suitable target (not shown), such as a pellet placed at the tip of the anode for producing and heating a plasma. The high concentration of electrons 22 striking the tip of the anode 14 produces intense x-rays (Bremsstrahlung) by the rapid deceleration of the electrons in the anode material. The Bremsstrahlung can be enhanced and further localized by positioning a target made from a material having a higher atomic number than that of the anode at the tip of the anode 14. Also, the anode 14 may be coated, except at the region of its tip, with a material having a lower atomic number than the anode such that the rapid deceleration of the electrons 22 produces x-rays primarily at the tip location.

The ions 26 within the plasma 24 accelerate radially outward from the anode 14. The ion flux is controlled by the production of plasma which depends on the material on the surface of the anode.

Since the impedance of the device is determined by the distance between the anode and cathode 10, the impedance can be controlled by the choice of diameters for the anode and bore 12. The length and outer diameter of the cathode have little influence on the impedance of the device. The bore 12 may be tapered if it is necessary to control the initial electric field at the cathode 10 and the emission properties of the cathode. The length of the anode has little effect on the electrical characteristics of the device. The average pinch propagation velocity is proportional to the average current of the device.

Figure 5:
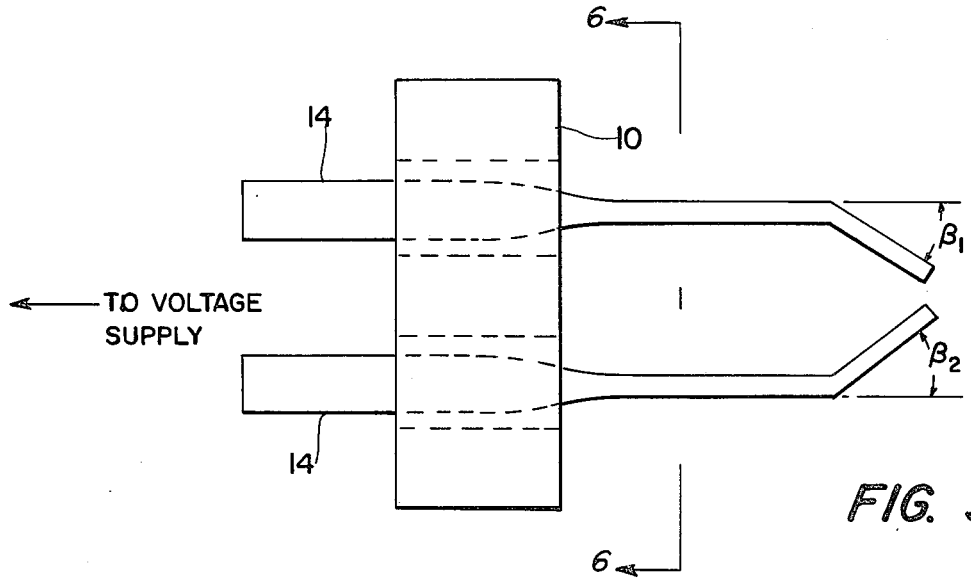
FIG. 5 is a diagrammatic view of an anode structure having two rods positioned relative to a cathode.
Figure 6:
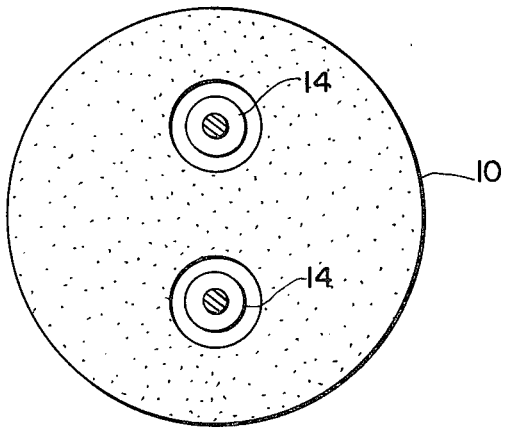
FIG. 6 is a sectional view of the anode structure shown in FIG. 5 taken along the line 6—6.

A number of anodes 14, two as depicted in FIG. 5 and FIG. 6, may be connected in parallel to a high-voltage supply, extended through a cathode 10 as described herein, curved at angles $\beta_1$ and $\beta_2$ at a point along the section of narrow diameter and pulsed simultaneously. An electron beam pinch propagates along each curved anode 14 at an angle $\beta$ as large as approximately 160° over a few centimeters. Curving the anode 14 in a single or multi-anode application provides more control over the application of the beam pinch.

Anodes of different materials, or anodes coated with conductive or dielectric material, such as titanium deuteride or grease, provide similar results except that the speed of plasma formation and, therefore, the pinch propagation velocity is different and different ions are accelerated As an alternative electrical configuration, the anode 14 may be grounded and a negative-polarity pulse may be applied to the cathode 10 by the voltage supply 20. Thus, pulsed power generators which only supply negative pulses may be used. Furthermore, in this configuration the anode 14 is at ground potential.

Obviously many modifications and variations of the present invention are possible in light of the above teachings. It is therefore to be understood that within the scope of the appended claims the invention may be practiced otherwise than as specifically described.

What is claimed and desired to be secured be Letters Patent of the United States is:

1. In an electron pinch diode receiving an electrical pulse from a high-voltage pulse generator, the improvement comprising:

a cathode, having a bore which extends through the cathode, said cathode being formed from a material which rapidly emits electrons during the early stage of said electrical pulse; and an anode, fabricated from an electrically conductive material and formed in the shape of a rod having a section of wide diameter, a section of narrow diameter, and a medial taper therebetween, said anode extending through said bore of the cathode and being spaced from the cathode, and electrically connected to the pulse generator for pinching said electrons emitted from the cathode and propagating the electrons along the length of said anode.

2. The improvement as recited in claim 1, wherein said cathode is formed from carbon.

3. The improvement as recited in claim 1, wherein said anode is fabricated from a material selected from the following group of metals: brass, copper, stainless steel, lead, and tantalum.

4. The improvement as recited in claim 1, wherein said taper of the anode is gradual and terminates in a smooth, curved transition to the remainder of the anode for maintaining the propagation of the electrons along said transition.

5. The improvement as recited in claim 1, wherein the section of narrow diameter of said anode is curved at an angle from the longitudinal axis of the remainder of said anode.

6. The improvement as recited in claim 4, wherein the angle of said taper is approximately 20°.

7. The improvement as recited in claim 4, wherein the number of said anodes is at least two.

8. The improvement as recited in claim 5, wherein the number of said anodes is at least two.

* * * * *